US008725013B2

(12) United States Patent
Nose

(10) Patent No.: US 8,725,013 B2
(45) Date of Patent: May 13, 2014

(54) IMAGE FORMING APPARATUS USING A TRANSPARENT TONER

(75) Inventor: Katsuya Nose, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 59 days.

(21) Appl. No.: 13/596,788

(22) Filed: Aug. 28, 2012

(65) Prior Publication Data

US 2013/0051822 A1 Feb. 28, 2013

(30) Foreign Application Priority Data

Aug. 31, 2011 (JP) ..... 2011-188963

(51) Int. Cl.
*G03G 15/08* (2006.01)

(52) U.S. Cl.
USPC ..... 399/29; 399/257

(58) Field of Classification Search
USPC ..... 399/27, 29, 223, 257
See application file for complete search history.

(56) References Cited

U.S. PATENT DOCUMENTS 7,349,653 B2 * 3/2008 Nishihama et al. ..... 399/223

FOREIGN PATENT DOCUMENTS

JP 2003-263027 A 9/2003
JP 2006-023327 A 1/2006

* cited by examiner

*Primary Examiner* — Hoang Ngo
(74) *Attorney, Agent, or Firm* — Canon USA Inc. IP Division

(57) ABSTRACT

An image forming apparatus capable of forming an image with a color toner and a transparent toner does not always form an image using the transparent toner. Under the circumstance where the image in which the transparent toner is more easily deteriorated than the color toner is output, if the deteriorated transparent toner is frequently discharged, the productivity may be lowered. Thus, when an amount of the transparent toner applied to the recording material that is acquired by an acquisition device is less than a predetermined amount, the transparent toner in the amount more than that acquired by the acquisition device is applied to the recording material.

5 Claims, 9 Drawing Sheets

COLOR TONER DISCHARGE PERFORMING DETERMINATION FLOW

S107: COLOR TONER DRUM DISCHARGE SEQUENCE (CLEANER REMOVAL)

TRANSPARENT TONER DISCHARGE PERFORMING DETERMINATION FLOW

S305: TRANSPARENT TONER RECORDING MEMBER DISCHARGE SEQUENCE

S307: TRANSPARENT TONER DRUM DISCHARGE SEQUENCE (CLEANER REMOVAL)

IMAGE FORMING APPARATUS USING A TRANSPARENT TONER

BACKGROUND OF THE INVENTION

1. Field of the Invention

The present invention relates to an image forming apparatus employing an electrophotographic method, and particularly to an image forming apparatus forming an image using a transparent toner.

2. Description of the Related Art

In an image forming apparatus employing an electrophotographic method, if images having a low printing ratio (small toner consumption) are output at a high ratio, a toner stays in a developing device and thus becomes deteriorated. More specifically, a developing blade and the toner for forming a toner layer are slid and rubbed on a developing sleeve for a long period, and thus an external additive externally added to the toner may fall off, or the external additive may be buried into a surface of the toner. As described above, if the external additive falls off from the surface of the toner or buried thereinto, a charging characteristic or flowability of the toner is deteriorated (hereafter, referred to as "the toner is deteriorated"). The deterioration of the charging characteristic and the flowability of the toner causes toner scattering and image fogging, which are not preferable.

To address such an issue, Japanese Patent Application Laid-Open No. 2003-263027 discusses that, when the toner is deteriorated at a high ratio, the toner is applied (discharged) to a photosensitive member from a developing device to refresh the toner staying therein.

More specifically, each time the developing sleeve is driven for a predetermined time, an amount of toner consumed in the predetermined time is calculated. When a calculation result is lower than a predetermined value, the deterioration of the toner may be advanced, and thus the toner in the developing device is discharged to the photosensitive member and collected by a cleaner without being transferred to a recording sheet. Further, the toner (new toner) in the amount corresponding to the discharged toner (deteriorated toner) is supplied for the developing device so that the toner does not stay in the developing device for a long period.

Similarly, Japanese Patent Application Laid-Open No. 2006-023327 discusses a method for refreshing the toner in the developing device based on a value (e.g., a video count value for each image formation) indicating the amount of toner to be used for each image formation. More specifically, the method discusses that, when the video count value is smaller than the set predetermined threshold value, a difference therebetween is calculated, and, when an integrated value acquired by integrating the calculated differences reaches the predetermined value, the toner is discharged from the developing device for refreshing.

In recent years, an image forming apparatus has been discussed that uses a transparent toner for adjusting glossiness in addition to color toners of yellow, magenta, and so on.

Usages of the transparent toner are known in which the transparent toner is applied all over a region where an image can be formed of a sheet to give an image glossiness like a silver halide photograph, and in which the transparent toner is locally applied for purpose of forgery prevention or eye-catching (e.g., gloss mark and watermark). However, the image forming apparatus capable of forming an image with the color toner and the transparent toner does not always form the image using the transparent toner.

In other words, the image forming apparatus outputs the image having high glossiness such as the silver halide photograph and forms the gloss mark using the transparent toner according to an image forming mode selected by a user. Thus, unless the user always selects a mode for using the transparent toner, a consumption amount of the transparent toner tends to become smaller than that of the color toner.

If the consumption amount of the transparent toner is smaller than that of the color toner, the transparent toner tends to be deteriorated sooner compared with the color toner. Thus, in a state where the transparent toner becomes deteriorated sooner than the color toner, a down time occurs due to frequent discharge of the transparent toner from the developing device, so that productivity may be lowered.

SUMMARY OF THE INVENTION

The present invention relates to an image forming apparatus including a developing device for developing a transparent toner and a toner discharge device for preventing deterioration of the transparent toner, so that lowering of the productivity can be reduced to minimum while the transparent toner is prevented from being deteriorated.

According to an aspect of the present invention, an image forming apparatus includes a transparent image forming unit configured to form an image of a transparent toner on a recording material, an acquisition device configured to acquire information about an amount of the transparent toner to be applied to the recording material, and a controller configured to, if the amount of the transparent toner to be applied to the recording material that is acquired by the acquisition device is less than a predetermined amount, perform control to apply the transparent toner to the recording material in an amount more than the amount of the transparent toner acquired by the acquisition device.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

An image forming apparatus according to a first exemplary embodiment of the present invention will be described in detail below. In the present exemplary embodiment, glossiness (gloss) is measured in a 60 degree gloss measurement (based on JIS Z 8741 Specular glossiness—Methods of measurement) mode by a handy gloss meter (PG-1M) manufactured by Nippon Denshoku Industries Co., LTD.

The image forming apparatus according to the present exemplary embodiment will be described for each item hereinbelow.

Figure 1:
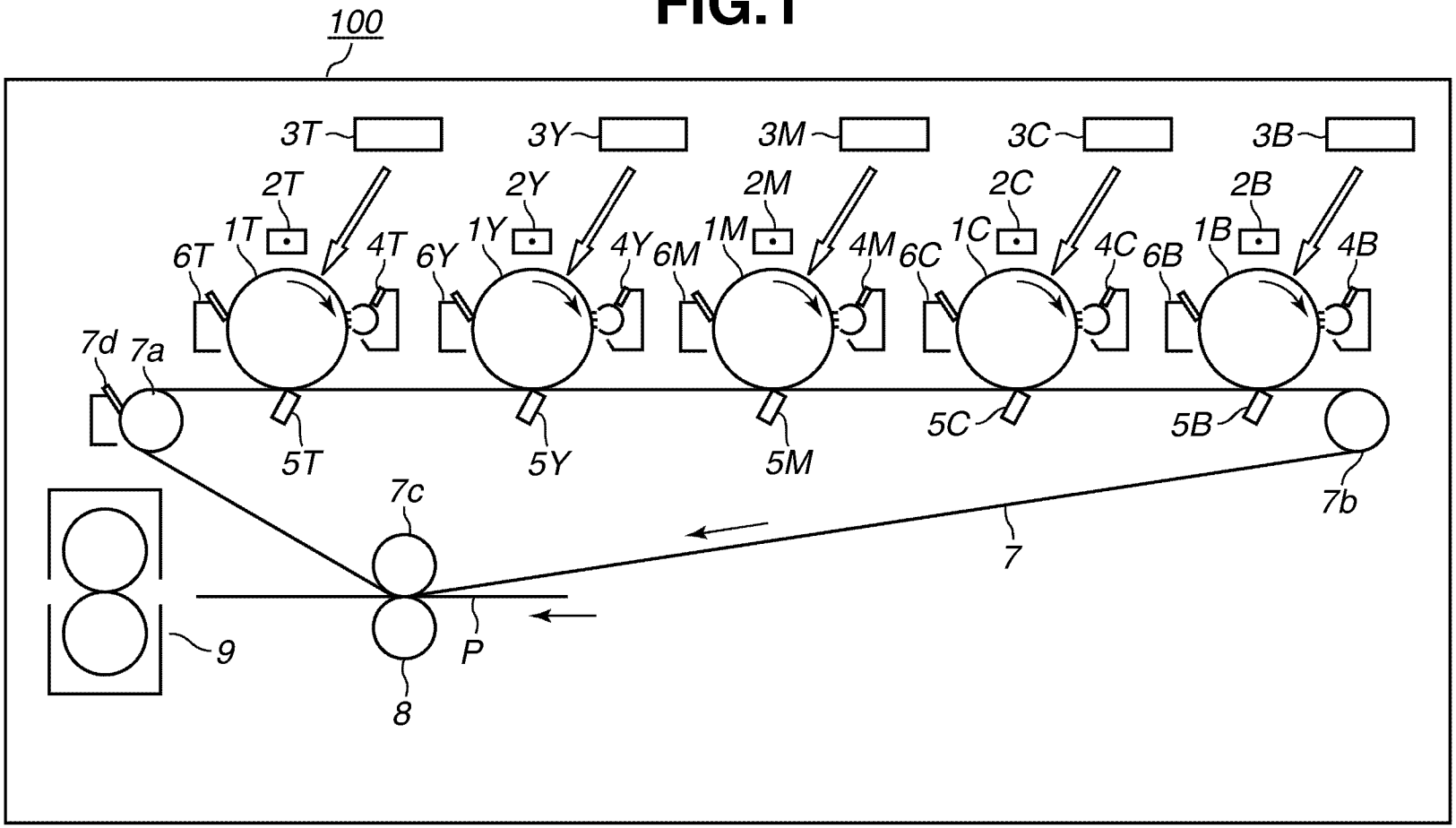
FIG. 1 is a schematic view of an image forming apparatus according to an exemplary embodiment of the present invention.

FIG. 1 is a schematic view illustrating a configuration of an image forming apparatus 100 according to the present exemplary embodiment. The image forming apparatus 100 includes photosensitive drums 1T, 1Y, 1M, 1C, and 1B as image bearing members, hereinafter referred to as photosensitive drums 1Y to 1T. Elements that are disposed in the periphery of each photosensitive drum to form a toner image on a recording material are collectively referred to as an image forming station. Below each image forming station, an intermediate transfer belt 7 serving as an intermediate transfer member is disposed, and the intermediate transfer belt 7 is stretched around rollers 7*a*, 7*b*, and 7*c*. The intermediate transfer belt 7 drives in a direction indicated by an arrow in FIG. 1 and carries and conveys the toner image formed on the photosensitive member of each image forming station to the recording material.

The image forming station will be briefly described with an example of a yellow station Y as a color image forming unit. According to the present exemplary embodiment, the photosensitive member is charged by a corona charger 2. An electrostatic image is formed on a charged photosensitive drum 1 with a laser beam irradiated from a laser scanner 3 serving as an exposure device. The electrostatic image formed on the photosensitive member is developed with a toner (a yellow toner, herein) stored in a development device 4.

The toner images formed by the respective image forming stations are transferred to the intermediate transfer belt 7 by respective transfer blades 5Y to 5T serving as primary transfer devices. The toner images of five colors (yellow, magenta, cyan, black, and transparent (YMCKT)) formed on the intermediate transfer belt 7 are transferred to a recording sheet P by a secondary transfer roller 8 serving as a secondary transfer device disposed facing to the roller 7*c*. The remaining transfer toner that has not been transferred to the recording sheet P and remains on the intermediate transfer belt 7 is removed by an intermediate transfer belt cleaner 7*d*.

The toner transferred to the recording sheet P used as a recording material is heated and melted to be fixed to the recording sheet P as being pressed by a fixing device 9. In addition, the remaining transfer toner remaining on the photosensitive drums 1Y to 1T after the primary transfer is removed by cleaning blades 6Y to 6T serving as cleaning members. A transparent station storing the transparent toner in a developer container and forming a transparent toner image on the photosensitive member is referred to as a transparent image forming unit relative to a color image forming unit.

Figure 2A:
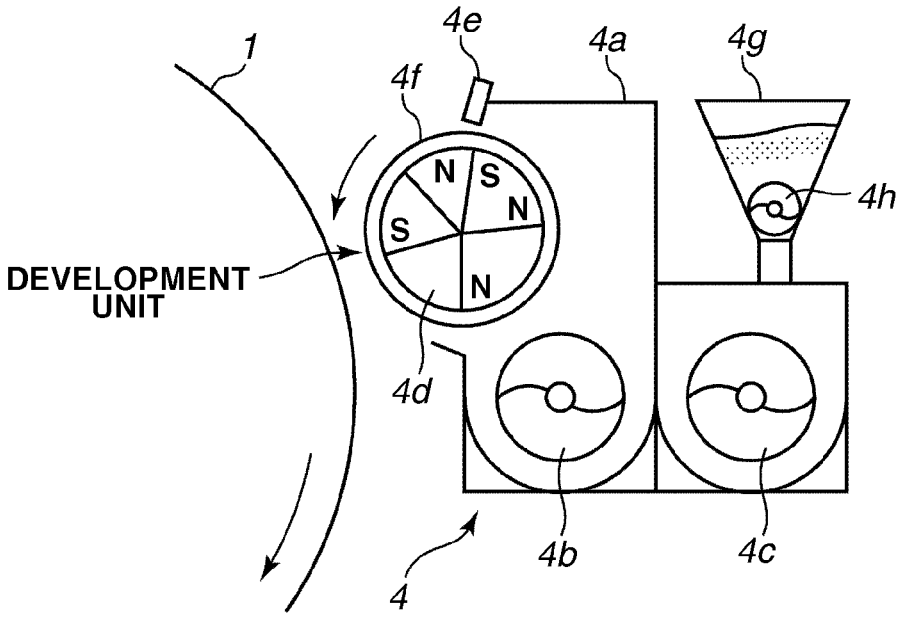
FIGS. 2A and 2B are schematic views of a developing device included in the image forming apparatus according to the present exemplary embodiment.
Figure 2B:
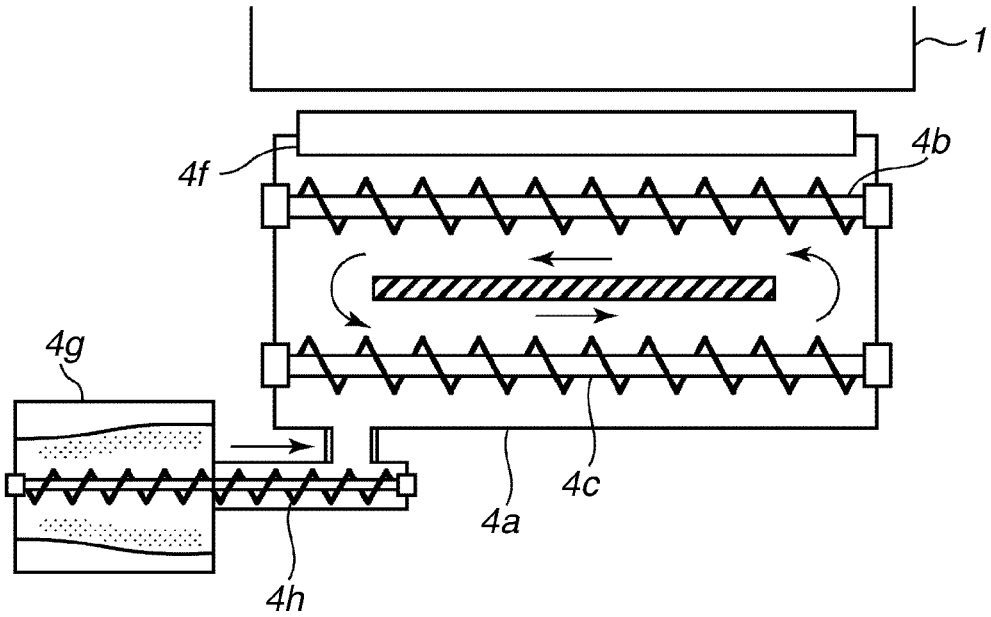

The developing device 4 will be described in detail below with reference to FIGS. 2A and 2B. FIG. 2A is a cross-sectional view of a periphery of the developing device 4. FIG. 2B is a bird's eye view of the periphery of the developing device 4.

The developing device 4 includes a developer container 4*a* storing the developer. The developer stored in the developer container 4*a* is two-component developer including toner and carrier. The developer stored in the developer container 4*a* is stirred by a stirring screw 4*c* disposed in a stirring chamber at a far side from a developing sleeve 4*f*, and the toner is slid and rubbed as being stirred by the stirring screw 4*c* to be charged.

The toner stirred in the stirring chamber is conveyed substantially parallel to the developing sleeve by a conveyance screw 4*b* disposed in a conveyance chamber at a closer side to the developing sleeve 4*f* separated by a partition wall (refer to an arrow illustrated in FIGS. 2A and 2B).

The developer conveyed by the conveyance screw 4*b* is carried by the developing sleeve 4*f* serving as a developer bearing device. Inside the developing sleeve 4*f*, a magnet roller 4*d* is disposed, and attracts the carrier to the sleeve to form magnetic brushes. The developing device 4 includes the developing blade 4*e* serving as a restriction member restricting the brushes of the developer borne on the developing sleeve 4*f*, and conveys to the developing unit the developer restricted by the developing blade 4*e*. More specifically, a space between the developing blade 4*e* and the developing sleeve 4*f* is restricted to 500 μm, and a coating amount of the developer per unit of area on the developing sleeve 4*f* is restricted to 30 mg/cm$^2$.

According to the present exemplary embodiment, the diameter of the developing sleeve 4*f* is set to 20 mm, the diameter of the photosensitive drum 1 is set to 80 mm, and a length of the closest region between the developing sleeve 4*f* and the photosensitive drum 1 is set to 400 μm. Further, the developing sleeve 4*f* is made of stainless steel (non-magnetic material), and the magnet roller 4*d* serving as a magnetization device is non-rotatably disposed therein. Furthermore, developing bias voltage acquired by superimposing direct current (DC) voltage of −500 V and alternate current (AC) voltage having peak-to-peak voltage of 1800 V and frequency f of 12 kHz is applied to the developing sleeve 4*f* according to the present exemplary embodiment.

A supply mechanism for supplying the toner corresponding to the consumption in the development to the developer container will be described.

As illustrated in FIG. 2A, a hopper 4*g* storing the two-component developer in which the toner and the carrier are mixed is disposed at an upper portion of the developing device 4. The two-component developer for supply in the hopper 4*g* is supplied to the developer container by a developer supply screw 4*h*. The supply screw 4*h* is rotated according to the amount of toner consumed by the developing device 4, and then the developer is supplied from the hopper 4*g* to the developer container 4*a*. A supply amount of the developer to be supplied from the hopper 4*g* to the developer container 4*a* is substantially determined by the number of rotations of the supply screw 4*h*. The number of rotations of the developer supply screw 4*h* is determined by a video count value of the image data and a detection result of a density sensor (not illustrated) for detecting a density of the toner image (patch) acquired by developing the electrostatic image as a reference formed on the photosensitive drum 1, which are described below.

The developer stored in each developer container will be briefly described. The toner according to the present exemplary embodiment is the two-component developer including the toner and the carrier. As the toner stored in each developer container according to the present exemplary embodiment, the substantially same toner except for the color of a coloring material is used.

The toner is produced by dispersing the coloring material such as a pigment into bonding resin (binder) such as polyester. Particles, which are referred to as an external additive, of colloidal silica fine powder or the like are externally added to the toner to improve the flowability and the charging characteristic of the toner. As the toner used in the present exemplary embodiment, a polyester-based resin having negative-chargeability is used as a bonding resin, and a volume mean particle diameter of the toner is 4 μm or more and 10 μm or less.

As the carrier used in the present exemplary embodiment, weighted oxide ferrite having a weight mean diameter of 20 to 60 μm and a resistance ratio of 107 Ωcm or more was used. In addition, metal including iron, nickel, cobalt, manganese, chromium, rare earth metals, and alloy thereof can be also used as the carrier.

The transparent toner is substantially the same as the color toner (YMCK) except that the coloring agent (pigment) included in the color toner is not included in the transparent toner. When the transparent toner is not fixed yet, it may scatter light and seem to be white according to the diameter of the particle. However, after the transparent toner is heated and fixed to the recording material by a fixing device, it is melted to form a colorless transparent toner layer.

A system configuration of a control circuit for controlling each unit of the image forming apparatus will be described with reference to a block diagram. Further, the video count value will be described in detail, which is used in the present exemplary embodiment as information corresponding to the toner consumption amount.

Figure 3:
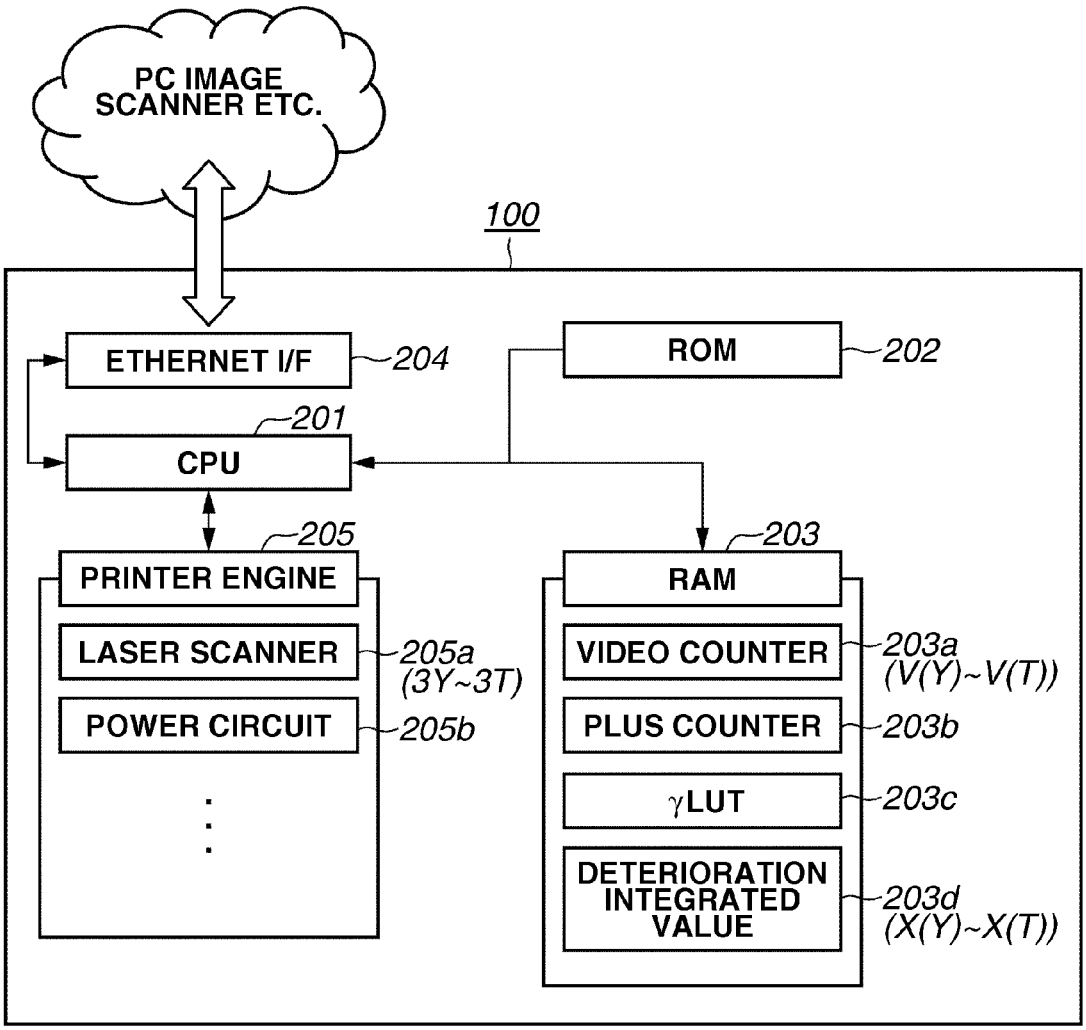
FIG. 3 is a block diagram illustrating a configuration of an image processing unit of the image forming apparatus according to the present exemplary embodiment.

FIG. 3 is the block diagram illustrating the system configuration of the image forming apparatus 100. The image forming apparatus 100 includes a central processing unit (CPU) 201 serving as a control device (controller) for controlling each unit of the image forming apparatus. Further, the apparatus includes a read only memory (ROM) 202 and a random access memory (RAM) 203 that store a control program. The CPU 201 operates according to the program stored in the ROM 202. The RAM 203 stores the video count value and a pulse count value to allow a video counter 203*a* and a pulse counter 203*b* to function, and expands a γ look up table (γLUT) 203*c* to be used for image processing. The CPU 201 processes the image data input using information stored in and expanded by the RAM 203.

The image forming apparatus 100 further includes an Ethernet (registered trademark) interface (I/F) 204 serving as a reception device for receiving an image forming signal from external or a signal of the image to be formed on the recording material. The image forming apparatus is connected to an information processing apparatus of a personal computer (PC) or an image scanner connected via an interface such as the Ethernet (registered trademark) I/F 204, and outputs the image with a printer engine 205 according to the input image signal.

Many image signals input from the external are input as a red, green, and blue (RGB) signal, and the CPU 201 converts the RGB signal into a CMY image according to a program. More specifically, the CPU 201 converts RGB image data as luminance data input by LOG conversion into CMY image data as density data. Further, the CPU 201 performs under color removal (UCR) processing and density correction processing using the γLUT expanded by the RAM 203 on the CMY image data. As described above, the input image data is processed into the YMCK image data as the image data which the printer engine can output. Further, the RAM 203 can store information such as variables (e.g., deterioration integrated value 203*d*: X(Y) to x(T)) used for control described below.

According to the present exemplary embodiment, transparent image data (T image data) specifying the image to be output using the transparent toner specifies how much transparent toner is applied to each region (pixel).

The CPU 201 serving as the control device generates, based on the image data expanded on the RAM 203, a pulse signal to be transmitted to the laser scanner 3 performing exposure on the photosensitive member included in the image forming station of each color. More specifically, to perform the exposure for applying a desired amount of toner to the photosensitive member, the CPU 201 performs pulse width modulation (PWM) processing to generate the pulse signal. According to the present exemplary embodiment, the image data is converted such that the more the image data includes density levels (e.g., 256 levels), the longer a pulse width of the pulse signal becomes. The converted pulse signal is, then, transmitted to the laser scanner 3 (205*a*) of the printer engine 205. Further, similarly, the CPU 201 serving as the control device controls each unit (e.g., a power circuit 205*b* for applying the voltage to the developing device) of the printer engine 205.

According to the present exemplary embodiment, the video count value is used as the information to be an indicator of the consumption amount of the toner. The video count value indicates a value acquired by integrating the density levels (0 to 255th levels) in one plane of the image for each pixel in the YMCK image data acquired by converting the input image data. In other words, the video count value can be acquired when the CPU 201 serving as an acquisition device converts the RGB image data. For the convenience of description, when an image in an A4 size is output with resolution of 600 dot per inch (dpi) and gradation of 8 bits (256 levels), the video count value is defined as 512 when the toner is applied at 255th level all over a surface of the output image.

According to the present exemplary embodiment, the CPU 201 stores in the RAM 203 the video count value of each color acquired from the YMCK image data. More specifically, the image data of the YMCK image data to be used by the laser scanner 3Y in the yellow station for the exposure is stored in the RAM 203 as the video count value V (Y) as the information as the indicator of the consumption amount of the yellow toner. Regarding other colors, the video count value V (M) as the indicator of the consumption amount of the magenta toner, and those of other colors (CKT) are also stored in the RAM 203 in the similar manner.

As the information to be the indicator of the consumption amount of the toner, in place of the video count value, the counted number of pulses (or, a time when the pulse is ON) of signals for driving the laser scanner and being input to the laser scanner 3 may be used. In this case also, similarly to the video count value, the number of pulses for each color may be stored in the RAM 203.

Discharge control of the deteriorated toner, which is a feature of the present invention, will be described with reference to flowcharts. It is conventionally known that, if the toner is slid and rubbed by the developing blade or screw for long hours in the developing device, the external additive falls off from the surface of the toner or is buried thereinto. As described above, when the deteriorated toner is included at a high ratio, the flowability and the charging characteristic of the toner are deteriorated to lower quality of the output image. Thus, to reduce the lowering of the quality of the image output to the recording material, the down time (period for suspending continuous image formation) is provided, and the deteriorated toner in the developing device 4 is developed on a non-image region (i.e., a sheet interval) of the photosensitive drum 1 to refresh the deteriorated toner.

In the apparatus capable of forming an image using the transparent toner and the color toner, the consumption amount of the transparent toner can be smaller than that of the color toner according to an image forming mode selected by a user. More specifically, when the gloss mark is formed by partially applying the transparent toner, or when an image is formed with only the color toners without using the transparent toner, the consumption amount of the transparent toner is small. Therefore, if an operation (sequence) for discharging the deteriorated toner included in the station forming the image with the transparent toner is similarly set to that of the color toner, productivity will be greatly reduced. According to the present exemplary embodiment, the discharge control of the transparent toner having priority over the above-described issue will be described with reference to the flowcharts.

Figure 4:
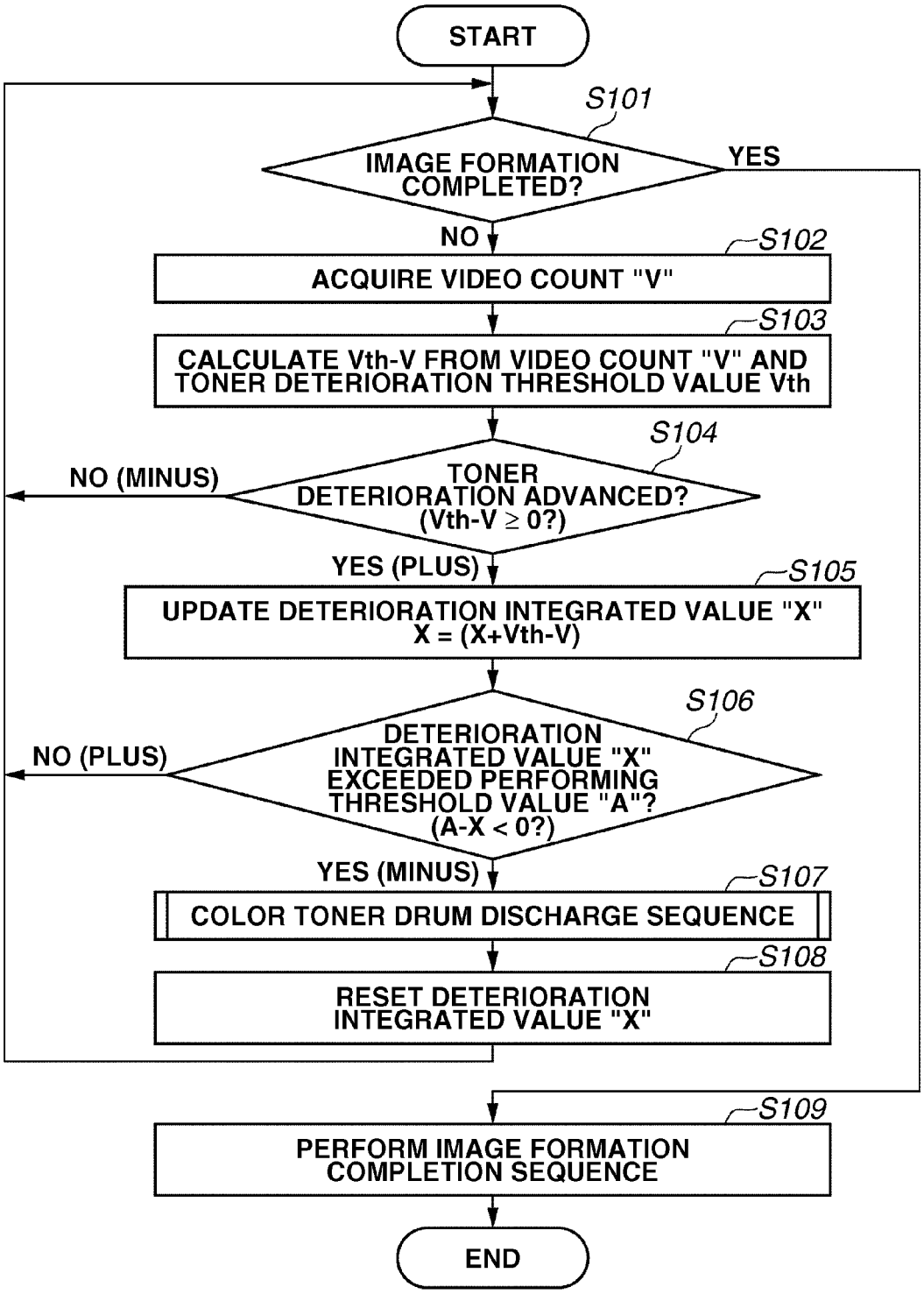
FIG. 4 is a flowchart illustrating determination of performing color toner discharge.

FIG. 4 is a flowchart illustrating timing for executing discharge of the color toner. The processing in step S107 for discharging the deteriorated color toner and also supplying the new toner will be described in detail in the next section.

The discharge control controls the deteriorated toner to be forcibly consumed when the consumption of the toner is small in the continuous image formation. Until the image specified by a series of input image formation instructions (an image forming job) is output, in other words, if the image formation has not been completed (NO in step S101), the CPU 201 serving as the control device continues the processing in steps of S102 to S108. When the entire input image is output (YES in step S101), then in step S109, an image formation completion sequence is performed. An operation performed during the continuous image formation will be described in detail below.

In step S102, the CPU 201 serving as the control device calculates (acquires) the video count value of each color from the input image signal. If a predetermined amount of toner or more is consumed every time one image is output, the new toner is appropriately supplied to the developer container, and thus a low ratio of the toner stays in the developer container for a long period.

At this point, the video count value has a correlative relationship (proportional relationship) with the amount of toner developed from the developer container to the photosensitive member during the image formation. Therefore, when the video count value of each color is less than a toner deterioration threshold value Vth corresponding thereto, it can be recognized that the consumption amount of the toner is small to cause the deterioration of the toner. On the other hand, when the video count value of each color is the toner deterioration threshold value Vth corresponding thereto or more, it can be recognized that the consumption amount of the toner is large enough and the deterioration of the toner does not advance. The toner deterioration threshold value Vth will be described in detail in the following section.

From the above-described reasons, in step S103, the CPU 201 calculates a difference between the video count value V acquired in step S102 and the toner deterioration threshold value Vth. Then in step S104, the CPU 201 branches the processing on condition based on the value (Vth−V). More specifically, when the value (Vth−V) is plus ("plus" includes "0" in the present exemplary embodiment) (YES in step S104), the CPU 201 advance the processing to step S105. When the value (Vth−V) is minus (NO in step S104), the CPU 201 returns the processing to step S101.

In step S104, when the toner deterioration threshold value Vth is larger than the video count value V acquired in step S102, it is regarded that the deterioration of the toner is advanced. The amount corresponding to the value (Vth−V) is regarded as the amount of the deteriorated toner. In step S106, when a deterioration integrated value X, which is an integrated value of the deteriorated toner amount, exceeds a predetermined value (YES in step S106), then in step S107, the sequence for discharging the color toner to the photosensitive drum is performed. The deterioration integrated value X for each color is stored in the RAM 203 similarly to the video count value V and the toner deterioration threshold value Vth.

The processing in step S107, which is defined processing, will be described in detail in the next section. The processing in step S107 is performed when any one of the deterioration integrated values X(Y), X(M), X(C), and X(K) of the color toners (YMCK) exceeds a performing threshold value A.

After the processing in step S107 is performed, then in step S108, the CPU 201 resets the deterioration integrated value X stored in the RAM 203, and subsequently performs the processing in step S101. The control procedure for estimating whether the color toner has been deteriorated during the continuous image formation is described as above. When a series of image formation is completed (YES in step S101), then in step S109, the CPU 201 controls the power circuit 205*b* so that the voltage to be applied to the image forming unit is subsequently turned off. When the sequence to be performed on the completion of the image formation is performed (when post-rotation is performed), the color toner corresponding to the deterioration integrated value X may be discharged to the photosensitive drum, and also the deterioration integrated value X may be reset.

Figure 5:
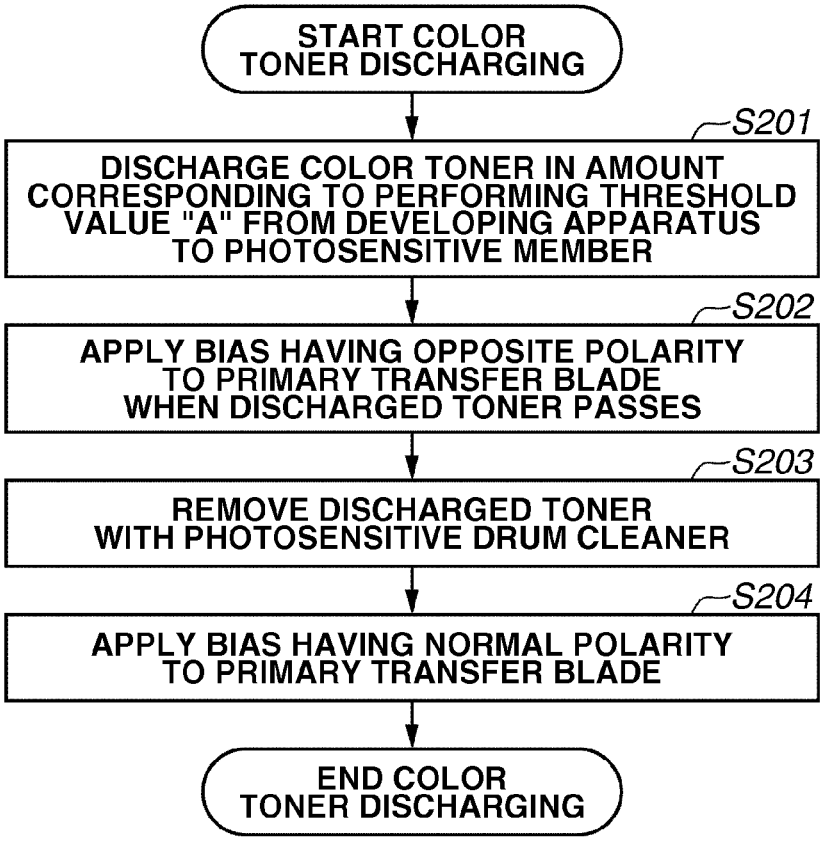
FIG. 5 is a flowchart illustrating color toner discharge sequence (drum).

The processing in step S107, which is the defined processing illustrated in FIG. 4, will be described in detail. FIG. 5 is a flowchart illustrating the processing performed in step S107 in detail. In step S106 in FIG. 4, when the deterioration integrated value X exceeds the performing threshold value A ((performing threshold value A−deterioration integrated value X)<0) (YES in step S106), the CPU 201 stops the continuous image formation and discharges the toner from the developer container to the photosensitive drum 1.

More specifically, in step S201, the CPU 201 discharges to the photosensitive drum the toner in the amount corresponding to the video count value of the performing threshold value A from the developer container included in the station of the color whose deterioration integrated value X exceeds the discharge performing threshold value A. At the same time, in the station of the color whose deterioration integrated value X does not exceed the performing threshold value A, the toner in the amount corresponding to the video count value corresponding to the current deterioration integrated value X is discharged to a region corresponding to the sheet interval of the photosensitive drum. To decrease the time (down time) necessary for discharging the deteriorated toner to the photosensitive drum to minimum, the photosensitive member is exposed such that the deteriorated toner is discharged in a belt-like shape in a longitudinal direction of the photosensitive drum.

In step S202, the CPU 201 performs control to apply the transfer bias having the polarity opposite to that when the image is normally formed to the transfer blade, so as not to transfer the toner discharged to the photosensitive drum to the intermediate transfer belt.

In step S203, the CPU 201 continues to drive the photosensitive drum to remove a toner belt that has passed a transfer unit with a cleaning blade that cleans the photosensitive drum of each station.

After the toner belt discharged to the photosensitive drum is removed with the cleaning blade, in step S204, the CPU 201 performs control to apply to the transfer blade the transfer bias having the polarity for forming an electric field for transferring the toner having a normal polarity from the photosensitive drum to the intermediate transfer member. The control for discharging the color toner to the photosensitive drum, when the toner is deteriorated at a certain degree or more, is described above.

As described above, when the user demands an output having high glossiness such as a silver halide photograph by applying the transparent toner all over the surface of the recording material, the large amount of transparent toner is consumed. On the other hand, it is conceivable to form an image only with the color toner without using the transparent toner. In such a case, the transparent toner is deteriorated more than the color toner, and the down time for discharging the transparent toner may lower the productivity. According to the present exemplary embodiment, the transparent toner in a small amount that cannot be perceived by the human eyes is discharged to the recording material on which the image is formed to reduce the deterioration of the transparent toner, so that the occurrence of the down time can be reduced.

Figure 6:
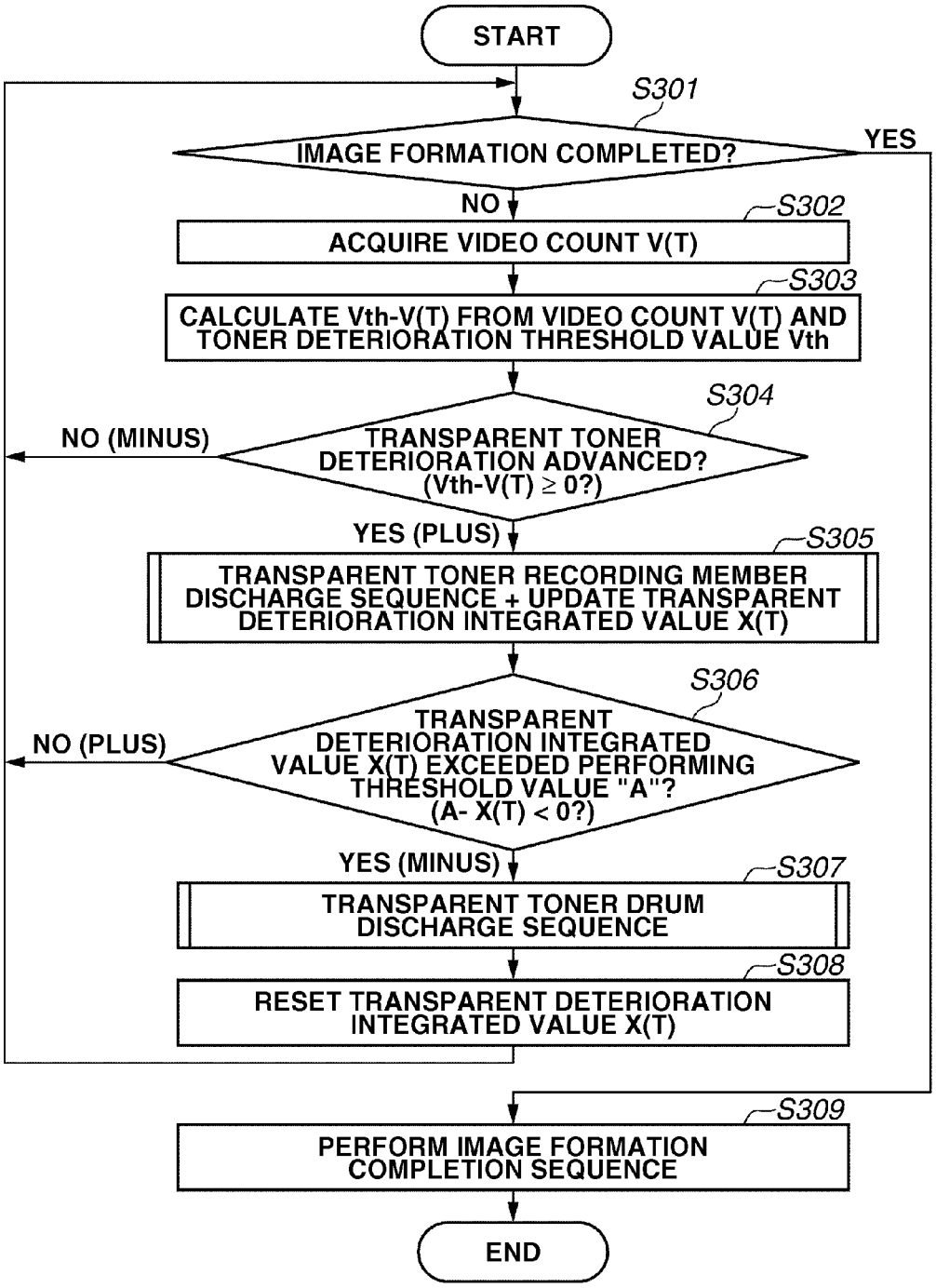
FIG. 6 is a flowchart illustrating determination of performing transparent toner discharge.

FIG. 6 is a flowchart illustrating timing for performing the discharge of the transparent toner. A sequence in step S305 in which a small amount of the transparent toner is discharged to the recording material and a sequence in step S307 in which the image formation is suspended and the deteriorated transparent toner is collected with the cleaning blade will be described in detail in the next section.

Until the image specified by a series of input image formation instructions (an image forming job) is output, in other words, if the image formation has not been completed (NO in step S301), the CPU 201 serving as the control device continues the processing in steps of S302 to S308. When the entire input image is output (YES in step S301), then in step S309, an image formation completion sequence is performed. The operation performed during the continuous image formation will be described in detail below.

In step S302, the CPU 201 serving as the control device calculates (acquires) the video count value V(T) as the information corresponding to the consumption amount of the transparent toner from the input image signal.

In step S303, the CPU 201 calculates a difference between the video count value V(T) acquired in step S302 and the toner deterioration threshold value Vth. Then in step S304, the CPU 201 branches the processing on condition based on the value (Vth−V(T)). More specifically, when the value (Vth−V(T)) is plus (YES in step S304), the CPU 201 advance the processing to step S305. When the value (Vth−V(T)) is minus (NO in step S304), the CPU 201 returns the processing to step S301.

In step S304, when the toner deterioration threshold value Vth is larger than the video count value V(T) acquired in step S302, it is regarded that the deterioration of the toner is advanced.

If the video count value V (T) of the transparent toner is less than the toner deterioration threshold value Vth, and if the value (Vth−V(T)) is added to the deterioration integrated value X(T) similarly to the color toner, the continuous image formation is frequently suspended to discharge the transparent toner. Thus, according to the present exemplary embodiment, in step S305, the transparent toner is applied to the recording material during the continuous image formation.

In step S305, the CPU 201 thinly applies the transparent toner in the sufficiently small amount that cannot be perceived by the human eyes on the recording material. Even if the transparent toner in the small amount that cannot be perceived by the human eyes is discharged to the recording material, the amount to be discharged has a limit. Thus, in step S305, the amount of the deteriorated transparent toner that has not been discharged to the recording material is reflected to the deterioration integrated value X(T) of the transparent toner.

In step S306, thus, the CPU 201 serving as the control device determines whether the deterioration integrated value X(T) updated in step S305 of the defined processing described below exceeds the performing threshold value A. When the deterioration integrated value X(T) of the transparent toner exceeds the performing threshold value A (YES in step S306), the CPU 201 advances the processing to step S307. When the deterioration integrated value X(T) of the transparent toner is less than the performing threshold value A (NO in step S306), the CPU 201 advances the processing to step S301.

When the deterioration integrated value X(T) of the transparent toner exceeds the performing threshold value A (YES in step S306), then in step S307, the continuous image formation is suspended and the deteriorated transparent toner is discharged to the photosensitive drum and removed with the cleaning blade. After the transparent toner in the amount corresponding to the performing threshold value A is removed with the cleaning blade, in step S308, the deterioration integrated value X(T) of the transparent toner is reset.

When a series of image formation is completed (YES in step S301), then in step S309, the CPU 201 controls the power circuit 205*b* to subsequently turn off the voltage to be applied to the image forming unit. When the sequence to be performed on the completion of the image formation is performed (when post-rotation is performed), the color toner and the transparent toner in the amount corresponding to the respective deterioration integrated values X(Y) to X(T) may be discharged to the photosensitive drum, and also the respective deterioration integrated values X(Y) to X(T) may be reset.

The discharge of the transparent toner to the recording material, which is characteristic control according to the present exemplary embodiment, will be described. Unlike the color toner, the transparent toner does not include the pigment (coloring agent). Since the transparent toner does not include the pigment, even after it is fixed, only the glossiness of the image is changed but not the color thereof. Therefore, unlike the color toner, if a minute amount of the transparent toner is applied to the recording material, it cannot be easily perceived by the human eyes.

Figure 7:
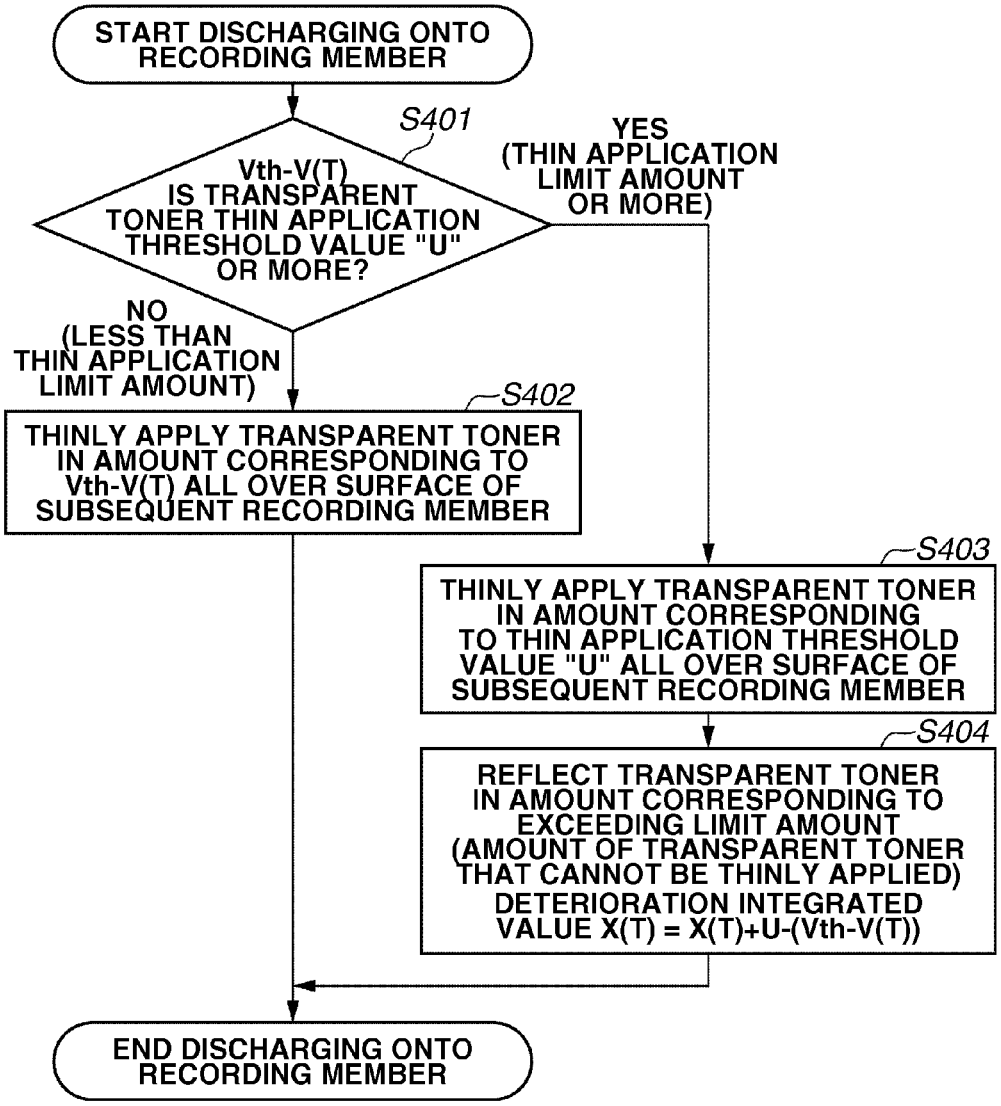
FIG. 7 is a flowchart illustrating transparent toner discharge sequence (recording material).

According to the present exemplary embodiment, to suppress a rate of increasing the deterioration integrated value X(T) of the transparent toner, the transparent toner is controlled to be discharged by a certain amount to the recording material during the continuous image formation. FIG. 7 is a flowchart illustrating the processing in step S305 illustrated in FIG. 6 in detail.

In step S401, the CPU 201 serving as the control device compares the value (Vth−V(T)) calculated in step S303 with a thin application threshold value U of the transparent toner. When the value (Vth−V(T)) is less than the thin application threshold value U (NO in step S401), then in step S402, the transparent toner in the amount corresponding to the value (Vth−V(T)) is uniformly applied all over the surface of the subsequent recording material. In this case, since the transparent toner in the sufficient amount for preventing itself from the deterioration can be consumed, the deterioration integrated value X(T) is not updated.

On the other hand, when the value (Vth−V(T)) is the thin application threshold value U or more (YES in step S401), then in step S403, the transparent toner in the amount corresponding to the thin application threshold value U is uniformly applied all over the surface of the recording material. If the transparent toner in the amount corresponding to the thin application threshold value U or more is applied all over the surface of the recording material, the glossiness of the continuously output recording materials varies as a level that the user can perceive it. Therefore, the transparent toner in the amount corresponding to the thin application threshold value U or more is not discharged to the recording material.

As described above, when the value (Vth−V(T)) is the thin application threshold value U or more, since the transparent toner cannot be sufficiently consumed and may be deteriorated. Thus, in step S404, the value (U−(Vth−V(T))) is added to the deterioration integrated value X(T) of the transparent toner. The sequence for thinly applying the transparent toner to the recording material during the continuous image formation is described as above.

As described in steps S401 to S404, even if a minute amount of the transparent toner is applied to the recording material on which the image is formed, the deterioration may accumulate in the transparent toner in the amount exceeding the thin application threshold value U. Therefore, when the deterioration integrated value X(T) of the transparent toner exceeds the performing threshold value A (YES in step S306), the sequence for suspending the continuous image formation and consuming the transparent toner is performed.

Figure 8:
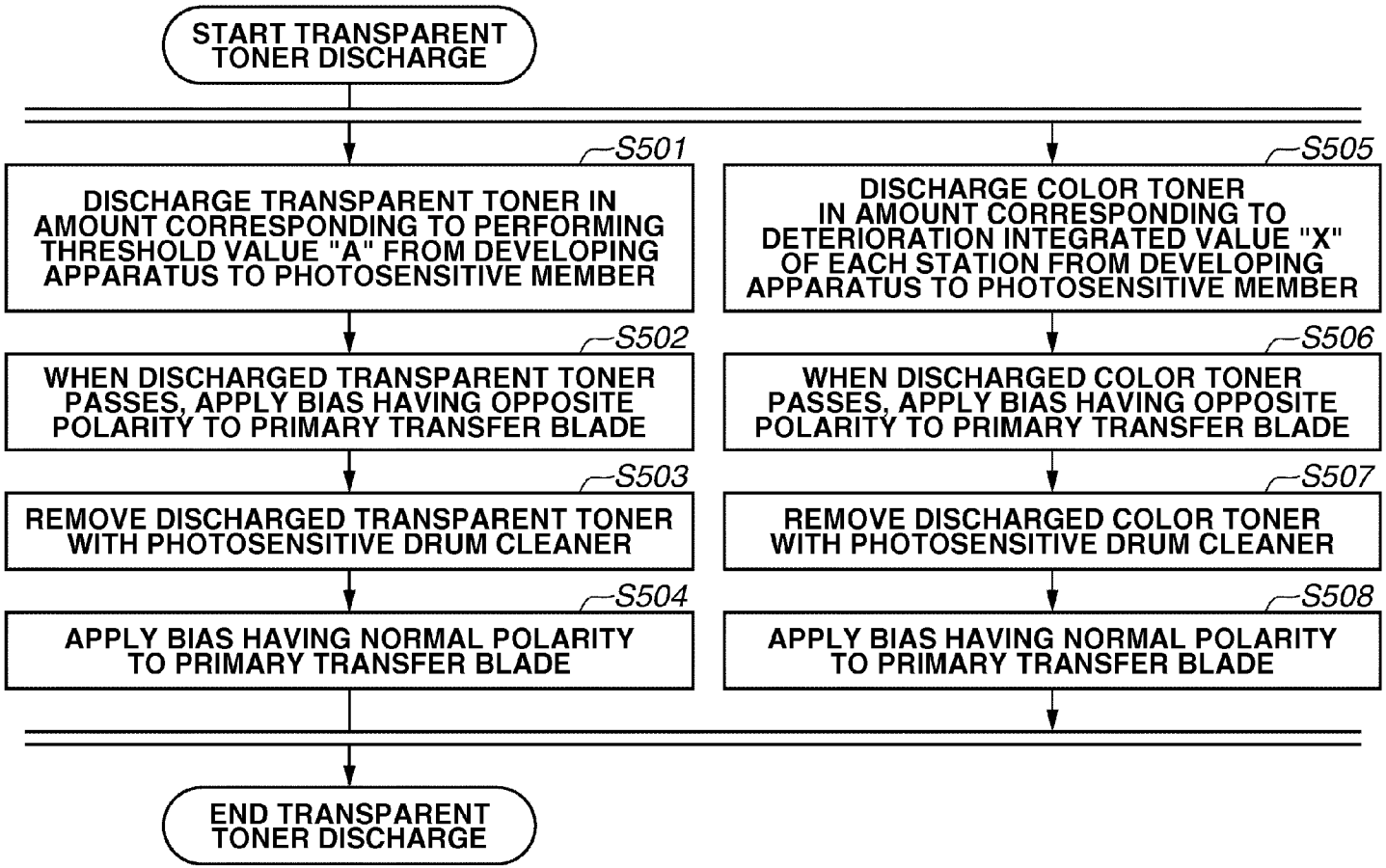
FIG. 8 is a flowchart illustrating transparent toner discharge sequence (drum).

FIG. 8 is a flowchart illustrating the processing in step S307 illustrated in FIG. 6 in detail. The CPU 201 performs the transparent toner discharge sequence in steps S501 to S504 and the color toner discharge sequence in steps S505 to S508 in parallel.

Similarly to the discharge sequence for discharging the color toner to the photosensitive drum as illustrated in FIG. 5, the CPU 201 serving as the control device controls the transparent toner to be discharged to the photosensitive drum. More specifically, in step S501, the CPU 201 performs control to discharge the transparent toner in the amount corresponding to the video count value of the performing threshold value A to the photosensitive drum from the developing container included in the transparent toner station in which the deterioration integrated value X exceeds the performing threshold value A.

In step S502, the transfer bias having the opposite polarity of the polarity to be applied to the transfer unit when the image formation of the transparent toner belt discharged to the photosensitive drum is performed at the transfer unit. In step S503, the transparent toner belt is removed with the cleaning blade. In step S504, upon completion of the removal of the transparent toner discharged to the photosensitive drum, the polarity of the transfer bias applied to the primary transfer blade is returned to the polarity to be applied when the image is formed.

In step S505, in parallel with the operation described above, the CPU 201 performs control to discharge the color toner in the amount corresponding to the deterioration integrated value X to the photosensitive drum from each color toner station. In step S506, the bias having the opposite polarity is applied to the transfer unit to convey the color toner belt to the cleaning blade. In step S507, the color toner is then removed with the cleaning blade. Subsequently, in step S508, the transfer bias is returned to a predetermined polarity.

The amount of the color toner discharged to each photosensitive drum in parallel with discharging the transparent toner thereto corresponds to the amount corresponding to the deterioration integrated value X(Y), X(M), X(C), or X(K) of each color of the corresponding station.

When the color toner is discharged as illustrated in FIG. 5, the transparent toner in the amount corresponding to the deterioration integrated value X(T) may be discharged in parallel.

The deterioration threshold value Vth, the performing threshold value A, and the thin application threshold value U used in the above-described flowcharts will be described by separating them into each item.

A method for determining the deterioration threshold value Vth will be briefly described below. The toner deterioration threshold value Vth is non-dimensional information that can be compared with the video count value V. The toner deterioration threshold value Vth is used to determine whether an image defect (deterioration including fogging, toner scattering, and a degree of particles) is caused by the deteriorated toner in the developing container due to the image formation at a predetermined printing ratio or less.

More specifically, the continuous image formation was performed on each one side of 1,000 sheets of an A4 size by varying the printing ratio of each color (0% to 10%), and then change in the image quality was checked before and after the continuous image formation. A table 1 illustrates the result of this experiment.

TABLE 1

| TONER DETERIORATION THRESHOLD VALUE | | COLOR | | | | |
|---|---|---|---|---|---|---|
| | | Y | M | C | K | T |
| PRINTING RATIO | 0% | x | x | x | x | x |
| | 1% | x | x | □ | x | x |
| | 2% | x | □ | □ | x | x |
| | 3% | □ | □ | □ | □ | x |
| | 9% | □ | □ | □ | □ | x |
| | 10% | □ | □ | □ | □ | □ |

In the table 1, "□" indicates that the image quality is not deteriorated, and "x" indicates that the deterioration of fogging, toner scattering, or degree of particles occurred. From the result in the table 1, the toner scattering was started in the yellow toner at the printing ratio of less than 3%, the magenta toner at that of less than 2%, the cyan toner at that of less than 1%, and the black toner at that of less than 3%. Further, when the printing ratio of the transparent toner was lower than 10%, the image deterioration due to the toner deterioration occurred.

Therefore, according to the present exemplary embodiment, the toner deterioration threshold value video counts are defined as Vth(Y)=15, Vth(M)=10, Vth(C)=5, Vth(K)=15, and Vth(T)=51. The toner deterioration threshold value video counts are calculated by rounding off after the decimal point. Naturally, the toner deterioration threshold value Vth varies depending on the material of the developer (toner and carrier), and thus may be calculated and set accordingly.

The performing threshold value A for determining whether to perform the sequence for discharging the toner to the photosensitive member will be described. The performing threshold value A is used to determine an amount of deteriorated toner to be collected in the developing container to perform the sequence for discharging the toner to the photosensitive drum. If the performing threshold value A is set low, the toner is discharged frequently to easily cause the down time, however the image defect is not easily caused since the deteriorated toner is contained in the developer container at a low ratio. On the other hand, if the performing threshold value A is set high, the toner is not discharged frequently to decrease the down time, however the deteriorated toner is contained in the developer container at a high ratio.

According to the present exemplary embodiment, the discharging sequence performing threshold value A is the same in the all stations. It is preferable that the performing threshold values A of the color toner YMCK are set lower than the performing threshold value A(T) of the transparent toner, since the minute difference in the amount of each toner YMCK to be developed easily affects the image as color difference. According to the present exemplary embodiment, the performing threshold value A is set to 512. This is because that, if the set value of the performing threshold value A, which is the threshold value for performing the discharge sequence, is too large, a time for advancing the toner deterioration until the toner is discharged becomes longer. Therefore, it is desirable that the performing threshold value A is equivalent to the video count value of an image in solid all over the surface of one side of a sheet in an A4 to A3 size (printing ratio is 100%). Further, the larger the volume of the developer container is (the more the amount of toner that can be contained is), the larger the performing threshold value A of the toner discharge can be set.

Regarding the control for discharging the transparent toner to a region of the recording material that is not specified by the user during the continuous image formation, a limit amount of the transparent toner to be discharged to the recording material will be described.

Generally, it is not preferable to apply the transparent toner to the region of the recording material that is not specified by the user. However, when the consumption amount of the transparent toner is small as compared with that of the color toner, the transparent toner is extremely frequently discharged to the photosensitive drum. To reduce the frequency of the discharge of the transparent toner to the photosensitive drum, the transparent toner is discharged to the recording material. However, the discharge of the too much transparent toner causes the user to perceive that.

More specifically, as a result of an experiment performed by the inventor's naked eyes, when a glossiness difference ($\Delta G$) was 1.5 or less, the difference could not be perceived by the naked eyes. In other words, when the glossiness difference is less than 1.5, the human's naked eyes cannot determine whether the transparent toner is fixed.

Therefore, an upper limit value of the transparent toner amount per unit area is set so that a change in the glossiness is less than 1.5 when a transparent toner layer is thinly formed on a region other than the specified region according to a detected sheet type. Then, the transparent toner in less than a predetermined amount is discharged.

Figure 9A:
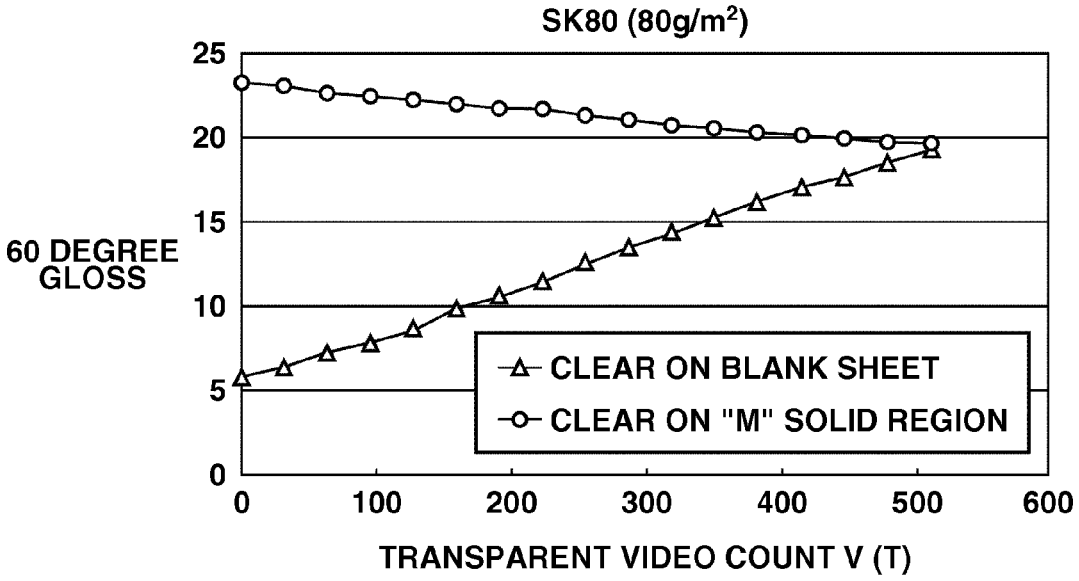
FIGS. 9A and 9B are graphs illustrating change of glossiness corresponding to a toner loaded amount of the transparent toner.
Figure 9B:
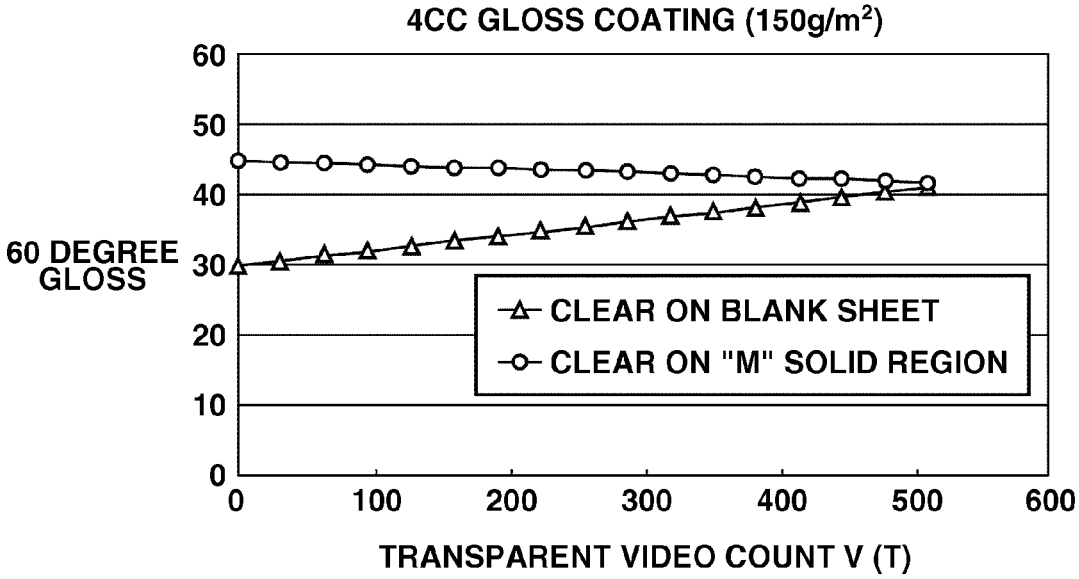

FIGS. 9A and 9B are graphs illustrating the changes in the glossiness when the loaded amount (g/cm$^2$) of the transparent toner per unit area corresponding to the video count value in a horizontal axis is applied to a recording material. In FIGS. 9A and 9B, line graphs with "Δ" symbols indicate cases where the toner other than the transparent (clear) toner was not loaded on the recording sheet, and line graphs with "□" symbols indicate cases where the transparent toner was printed on the color toner (magenta "M" in the experiment) previously printed in solid all over the surface of the recording sheet. The line graphs with "Δ" symbols and "□" symbols illustrated in FIGS. 9A and 9B indicate that the more the loaded amount of the transparent toner per unit area was applied, the larger the change of the surface glossiness became.

Therefore, the thin application threshold value U of the transparent toner was determined such that the human naked eyes cannot distinguish the change in the glossiness (1.5) on both the blank recording sheet and the recording sheet on which the image was formed with other color toner. In other words, the video count value when the transparent toner is thinly and uniformly applied all over one surface of the specified recording sheet is set as the video count value of the thin application threshold value U of the transparent toner.

Based on the difference between graphs in FIGS. 9A and 9B, it can be found that the thin application threshold value U of the transparent toner is to be varied according to a size and a type of the recording sheet and a fixing condition thereof.

For example, on an SK80 sheet in the A4 size having a grammage of 80 g/m$^2$ as illustrated in FIG. 9A, which is a recommended sheet for a color laser copier, the thin application threshold value U of the transparent toner is set to 32 that makes the glossiness change less than 1.5 when the recording sheet passes through a fixing device at a predetermined speed. Further, when fixing is performed on the SK80 sheet in the A3 size under the same fixing condition, the thin application threshold value U of the transparent toner is set to 64.

In addition, as illustrated in FIG. 9B, on a 4CC gross coating sheet in the A4 size having the grammage of 150 g/m$^2$, the thin application threshold value U of the transparent toner is set to 48 when the fixing is performed at a speed of one third of that when the SK 80 sheet is fixed.

According to the present exemplary embodiment, the transparent toner in the sufficiently small amount not to be recognized by the user is thinly applied to the recording material to reduce the occurrence of the down time generated by the necessity for frequently discharging the transparent toner.

Therefore, the CPU 201 serving as the control device acquires the type, the size, and the fixing condition of the recording material and changes the thin application threshold value U of the transparent toner according thereto. With this operation, the maximum amount of the transparent toner that is not be recognized by the user is discharged to the recording material to reduce the occurrence of the down time.

Discharge frequency when the continuous image formation is performed by the image forming apparatus controlled by the above-described flowcharts under image forming conditions described below will be described.

In a comparison example to be compared with the present exemplary embodiment, only a discharge sequence for discharging the deteriorated toner to the photosensitive drum is performed based on only the deterioration accumulated threshold values of the color toner and the transparent toner without thinly discharging the transparent toner to the region of the recording material that is not specified by the user. In other words, the comparison example does not perform the discharge control (step S306 in FIG. 6 and FIG. 7) for discharging the transparent toner by the minute amount to the recording material, which is the characteristic control of the present exemplary embodiment.

To perform an evaluation test, an image to be formed continuously will be described. In the evaluation test, an image (hereafter, referred to as a "test image") having the printing ratio per sheet for each color of YMCK, which are Y=10%, M=15%, C=20%, K=25%, and T=1%, is continuously output to the A4 sheet to be evaluated. The number of the discharges in a case where the same discharge control is performed for all colors (YMCKT), which are the comparison example and in a case where the discharge control is performed according to the present exemplary embodiment will be described below.

As described above, the video count value V is 512 when the solid image is output all over the surface of one side of the A4 sheet (the printing ratio of the image is 100%). Therefore, when the test image is output on the A4 sheet, the video count value V(Y) of yellow is 51, that V(M) of magenta is 77, that V(C) of cyan is 102, and that V(K) of black is 128. Further, the video count value V(T) of the transparent (clear) toner is 5.

A case where the above-described test image is continuously formed on 1,000 sheets in the A4 size by the image forming apparatus adopting the control of the comparison example will be described. When the test image is formed on one sheet, in the toner discharge control of the comparison example, the toner deterioration integrated value X is calculated as indicated in a table 2.

TABLE 2

| | COLOR | | | | |
|---|---|---|---|---|---|
| | Y | M | C | K | T |
| PRINTING RATIO (%) | 10 | 15 | 20 | 25 | 1 |
| VIDEO COUNT: V | 51 | 77 | 102 | 128 | 5 |
| TONER DETERIORATION THRESHOLD VALUE VIDEO COUNT: Vth | 15 | 10 | 5 | 15 | 51 |
| Vth − V | −36 | −67 | −97 | −113 | +46 |
| TONER DETERIORATION ACCUMULATED VALUE PER SHEET: X | 0 | 0 | 0 | 0 | +46 |

As illustrated in the table 2, each time one sheet of the test image is output, the toner deterioration integrated value X(T) of the transparent toner is increased (integrated) by 46. In other words, when the test image is output, the deterioration of the transparent toner advances faster than other toner.

As described above, the discharge performing threshold value A is 512, and thus, the image forming apparatus adopting the control of the comparison example performs the discharge sequence each time twelve sheets of the test image (512/46) are output.

Therefore, when 1,000 sheets of the test image are continuously output by the apparatus adopting the control of the comparison example, the image formation is suspended as much as 83 times to discharge the toner.

Subsequently, the number of the discharges to be performed when the above-described 1,000 sheets of the test image are continuously output by the apparatus adopting the control according to the present exemplary embodiment, will be described.

A table 3 illustrates transition of the toner deterioration integrated value X in the image forming apparatus adopting the control according to the present exemplary embodiment.

TABLE 3

| | COLOR | | | | |
|---|---|---|---|---|---|
| | Y | M | C | K | T |
| PRINTING RATIO (%) | 10 | 15 | 20 | 25 | 1 |
| VIDEO COUNT: V | 51 | 77 | 102 | 128 | 5 |
| TONER DETERIORATION THRESHOLD VALUE VIDEO COUNT: Vth | 15 | 10 | 5 | 15 | 51 |
| Vth − V | −36 | −67 | −97 | −113 | +46 |
| U | — | — | — | — | +32 |
| (Vth(T) − V(T)) − U | — | — | — | — | +14 |
| TONER DETERIORATION ACCUMULATED VALUE PER SHEET: X | 0 | 0 | 0 | 0 | +14 |

When the control according to the present exemplary embodiment is adopted, the video count value of the transparent toner when one sheet of the test image is output is 5. The difference between the deterioration threshold value Vth (T) of the transparent toner and the video count value V(T) thereof, which are the same as the comparison example, is +46.

According to the present exemplary embodiment, the transparent toner is applied in the sufficiently small amount not to be perceived by the human eyes even after the transparent toner is fixed all over the surface of the A4 sheet. As described above, the thin application threshold value U of the transparent toner is 32 when the A4 sheet of the SK80 type is used as the recording material. The information about the type of the sheet on which an image is formed is acquired by the CPU 201 serving as a sheet type acquisition device and stores the information in the RAM 203 serving as a sheet type storage unit.

When the test image is output, the value (Vth−V(T)) of 46 is larger than the thin application threshold value U of 32 (YES in step S401), then in step S403, the transparent toner in the amount corresponding to the thin application threshold value U of 32 is applied all over the surface of the subsequent A4 sheet.

The video count value of 14 corresponding to the deterioration amount (U−(Vth−V(T))), which is the deteriorated amount even if the transparent toner is thinly applied, is added to the deterioration integrated value X(T). Therefore, each time one sheet of the test image is output, the deterioration integrated value X(T) of the transparent toner is increased (integrated) by 14.

As described above, since the performing threshold value A of 512 is used to perform the discharge sequence for discharging the transparent toner to the photosensitive drum, the image forming apparatus adopting the control according to the present exemplary embodiment can perform the discharge sequence each time 37 sheets of the test image (512/14) are output.

Therefore, when 1,000 sheets of the test image are continuously output by the apparatus adopting the control according to the present exemplary embodiment, the image formation is suspended only 27 times, while the comparison example suspends the image formation as much as 83 times to discharge the toner. In other words, when the control according to the present exemplary embodiment is adopted, the down time can be reduced to about one third as compared to the control of the comparison example.

As described above, by adopting the control discussed in the present exemplary embodiment, the deterioration of the transparent toner in the case where the printing ratio thereof is low can be reduced without changing the glossiness to the extent that can be recognized with the naked eyes. Further, only when the deterioration of the transparent toner cannot be sufficiently reduced by the configuration in which the small amount of the transparent toner is consumed on the recording sheet, the image formation is suspended to perform the discharge operation.

In addition, when the color toner is deteriorated, the frequency of discharging the toner is not extremely increased, since the transparent toner and the color toner are controlled to be discharged to the photosensitive drum in parallel as illustrated in FIG. 8.

According to the present exemplary embodiment, the deterioration of the toner is determined based on the video count value, however, it may be substituted with other numeral values such as a rotation time of a developing sleeve, as long as it is a numeral value having a correlative relationship with the toner deterioration.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-188963 filed Aug. 31, 2011, which is hereby incorporated by reference herein in its entirety.

What is claimed is:

1. An image forming apparatus comprising:

a transparent image forming unit configured to form an image of a transparent toner on a recording material;

an acquisition device configured to acquire information about an amount of the transparent toner to be applied to the recording material; and a controller configured to, if the amount of the transparent toner to be applied to the recording material that is acquired by the acquisition device is less than a predetermined amount, perform control to apply the transparent toner to the recording material in an amount more than the amount of the transparent toner acquired by the acquisition device.

2. The image forming apparatus according to claim 1, wherein the acquisition device acquires information about a region of the recording material to which the transparent toner is to be applied, and wherein, if the amount of the transparent toner to be applied to the recording material that is acquired by the acquisition device is less than the predetermined amount, the controller performs control to apply the transparent toner in an amount less than the predetermined amount to a region other than the region to which the transparent toner is to be applied that is acquired by the acquisition device.

3. The image forming apparatus according to claim 1, wherein the acquisition device acquires a type of the recording material on which the image is to be formed, and wherein, if the amount of the transparent toner to be applied to the recording material that is acquired by the acquisition device is less than the predetermined amount, the controller changes the amount of the transparent toner to be applied to the recording material according to the type of the recording material acquired by the acquisition device.

4. The image forming apparatus according to claim 1, wherein the acquisition device acquires a video count of an image to be output to the recording material as information corresponding to a consumption amount of a toner.

5. The image forming apparatus according to claim 1, wherein, if the amount of the transparent toner to be applied to the recording material that is acquired by the acquisition device is less than the predetermined amount, the controller applies to the recording material the transparent toner in an amount more than the amount of the transparent toner acquired by the acquisition device, with a difference between glossiness of the recording material and glossiness when the transparent toner is fixed to the recording material being to less than 1.5 as an upper limit value.

* * * * *